US005660056A

United States Patent [19]

Arai et al.

[11] Patent Number: 5,660,056

[45] Date of Patent: Aug. 26, 1997

[54] AIR CONDITIONER

[75] Inventors: Yasuhiro Arai; Hideaki Motohashi; Tetsuo Sano, all of Tokyo, Japan

[73] Assignee: Kabushiki Kaisha Toshiba, Kawasaki, Japan

[21] Appl. No.: 372,684

[22] Filed: Jan. 17, 1995

[30] Foreign Application Priority Data

Jan. 17, 1994 [JP] Japan ..... 6-002981

[51] Int. Cl.[6] ..... F25B 13/00

[52] U.S. Cl. ..... 62/324.6; 62/524; 165/122

[58] Field of Search ..... 62/114, 324.1, 62/324.6, 515, 524, 525, 526; 165/150, 101, 122

[56] References Cited

U.S. PATENT DOCUMENTS

| | | | |
|---|---|---|---|
| 2,044,069 | 6/1936 | Erbach | 165/150 |
| 2,139,297 | 12/1938 | Bergdoll | 62/524 |
| 2,524,568 | 10/1950 | Kritzer | 62/526 |
| 3,142,970 | 8/1964 | Hale | 62/524 |
| 4,434,843 | 3/1984 | Alford | 165/150 |
| 5,417,279 | 5/1995 | Wada | 165/122 |

FOREIGN PATENT DOCUMENTS

| | | | |
|---|---|---|---|
| 3318429 | 11/1984 | Germany | 62/525 |
| 302079 | 12/1989 | Japan | 62/515 |
| 6088657 | 3/1994 | Japan | 62/515 |

*Primary Examiner*—William Doerrler
*Attorney, Agent, or Firm*—Foley & Lardner

[57] ABSTRACT

An air conditioner employs a non-azeotropic refrigerant mixture without deteriorating the heat-exchange efficiency and air-conditioning capability of an indoor heat exchanger of the air conditioner. The indoor heat exchanger (3) has a fin on which a first path (33), a second path (34), and a third path (35) for passing the refrigerant mixture are arranged. The first path passes the refrigerant mixture from the leeward side toward the windward side of an air flow produced by an indoor fan (7), to form a counterflow of the refrigerant mixture against the air flow. The second path passes the refrigerant mixture from the windward side toward the leeward side of the air flow. Although the second path forms a parallel flow of the refrigerant mixture with respect to the air flow, it achieves moderate heat-exchange efficiency because the number of rows of piping on the leeward side is greater than that on the windward side and because the rows of piping do not overlap one another with respect to the air flow. The third path passes the refrigerant mixture from the windward side toward the leeward side and again from the windward side toward the leeward side of the air flow, to partly realize a counterflow of the refrigerant mixture against the air flow, to thereby improve the heat-exchange efficiency.

17 Claims, 3 Drawing Sheets

AIR CONDITIONER

BACKGROUND OF THE INVENTION

1. Field of the Invention

The present invention relates to an air conditioner for carrying out a heat pump refrigerating cycle with a non-azeotropic refrigerant mixture to exchange heat with air.

2. Description of the Prior Art

To protect the global environment such as the ozone layer and to prevent global warming, it is necessary to use alternative refrigerants instead of R22 for air conditioners. There are several alternatives whose cycle temperature and pressure are similar to those of R22. Most of the alternatives are non-azeotropic refrigerant mixtures that show a large temperature gradient during a vapor-liquid changing process, to deteriorate heat exchange efficiency.

Due to the large temperature gradient, the temperature of a refrigerant mixture in a two-phase state in a heat-pump refrigerating cycle is low at the inlet of an evaporator and high at the outlet thereof. The temperature of the same is high at the inlet of a condenser and low at the outlet thereof. This phenomenon reduces the mean effective temperature difference between the refrigerant mixture and air serving as a heat source, to thereby deteriorate the heat exchange efficiency of the refrigerant mixture compared with a single refrigerant. This results in deteriorating the performance of the heat-pump refrigerating cycle.

To improve the heat exchange efficiency between a non-azeotropic refrigerant mixture and air, a Lorentz cycle is effective. This cycle opposes the flow of the refrigerant mixture to the flow of air. Japanese Unexamined Patent Publication No. 1-39960 discloses an air conditioner that achieves the Lorentz cycle. This disclosure employs two kinds of four-way valves to oppose the flow of a refrigerant against the flow of air during cooling and heating cycles.

This disclosure is expensive and complicated because of the two kinds of four-way valves.

SUMMARY OF THE INVENTION

An object of the present invention is to provide an air conditioner that works with a non-azeotropic refrigerant mixture without deteriorating air-conditioning performance and employs an indoor heat exchanger that shows improved heat-exchange and air-conditioning capabilities.

In order to accomplish the object, the present invention provides an air conditioner that employs a non-azeotropic refrigerant mixture to achieve a heat-pump refrigerating cycle with air as a heat source. The air conditioner includes an indoor heat exchanger having a fin. The fin includes rows of piping for passing the refrigerant mixture from the leeward side toward the windward side of an air flow produced by an indoor fan.

The present invention also provides an air conditioner having a compressor for compressing a non-azeotropic refrigerant mixture, to increase the temperature thereof, an outdoor heat exchanger connected to the compressor, for condensing and air-cooling the compressed refrigerant mixture, a throttle device connected to the outdoor heat exchanger, for reducing the pressure of the condensed refrigerant mixture, to further cool the refrigerant mixture, and an indoor heat exchanger for cooling room air with the cooled refrigerant mixture. The indoor heat exchanger has rows-of piping for passing the refrigerant mixture and a fan for blowing air toward the piping. The rows of piping are arranged to pass the refrigerant mixture from the leeward side toward the windward side of the blown air during a cooling cycle.

The compressor may be provided with a four-way valve for changing the direction of the flow of the refrigerant mixture, to properly switch cooling and heating cycles from one to another.

A part of the rows of piping may be arranged to pass the refrigerant mixture from the leeward side toward the windward side of the blown air during a cooling cycle.

A part of the rows of piping may be arranged to pass the refrigerant mixture from the windward side toward the leeward side of the blown air during a cooling cycle.

The rows of piping may be arranged to pass the refrigerant from the windward side toward the leeward side and from the leeward side toward the windward side of the blown air during a cooling cycle.

The indoor heat exchanger having the rows of piping for passing the refrigerant mixture may be bent in a V shape, and the indoor fan may be arranged on the inner side of the V shape.

An upper part of the V-shaped indoor heat exchanger may include two refrigerant paths, and a lower part thereof may include one refrigerant path.

In the refrigerant path that passes the refrigerant mixture from the leeward side toward the windward side of the blown air, the number of rows of piping on the windward side is greater than that on the leeward side. In the refrigerant path that passes the refrigerant mixture from the windward side toward the leeward side of the blown air, the number of rows of piping on the leeward side is greater than that on the windward side.

The accompanying drawings, which are incorporated in and form a part of the present invention, and the description serve to explain the principles of the present invention.

DETAILED DESCRIPTION OF THE EMBODIMENTS

Figure 1:
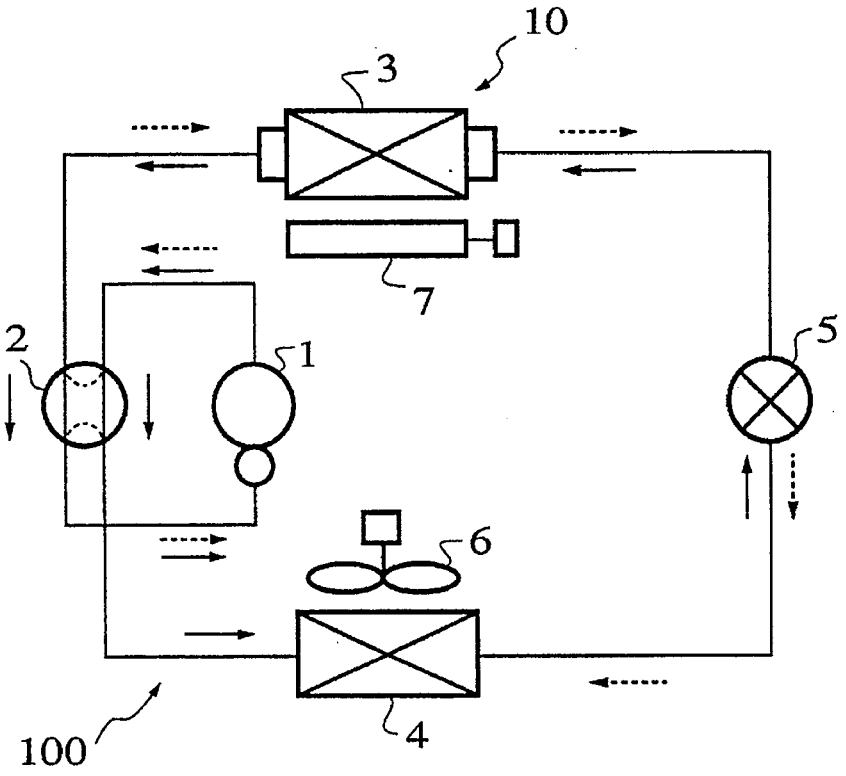
FIG. 1 shows a refrigerating cycle of an air conditioner according to an embodiment of the present invention.

FIG. 1 shows a refrigerating cycle of an air conditioner according to an embodiment of the present invention. The air conditioner employs a non-azeotropic refrigerant mixture. The air conditioner has an indoor unit 10 and an outdoor unit 100. The indoor unit 10 includes an indoor heat exchanger 3 and an indoor fan 7. The outdoor unit 100 includes a compressor 1, a four-way valve 2, an outdoor heat exchanger 4, a throttle device 5, and an outdoor fan 6.

A heating cycle of the air conditioner will be explained. The compressor 1 discharges a high-pressure high-temperature vapor of the refrigerant mixture, which is passed through the four-way valve 2 to the indoor heat exchanger 3 as indicated with dotted arrow marks. In the indoor heat exchanger 3, the vapor exchanges heat with room air blown by the indoor fan 7. Namely, the refrigerant mixture discharges heat and is condensed into a high-pressure liquid. The liquid is throttled by the throttle device 5 into a low-pressure low-temperature two-phase refrigerant mixture. The refrigerant mixture enters the outdoor heat exchanger 4, which heats the refrigerant mixture with outside air blown by the outdoor fan 6. Namely, the refrigerant mixture absorbs heat from the outside air, to evaporate. The heated low-pressure refrigerant mixture is passed through the four-way valve 2 to the compressor 1, which discharges a high-pressure high-temperature vapor of the refrigerant mixture. This completes the heating cycle.

A cooling cycle of the air conditioner will be explained. The compressor 1 discharges a high-pressure high-temperature vapor of the refrigerant mixture, which is passed through the four-way valve 2 to the outdoor heat exchanger 4 as indicated with continuous arrow marks. The vapor exchanges heat with outside air blown by the outdoor fan 6 and is condensed into a high-pressure liquid. The liquid is throttled by the throttle device 5 into a low-pressure low-temperature refrigerant mixture and is guided into the indoor heat exchanger 3. In the indoor heat exchanger 3, the refrigerant mixture exchanges heat with room air blown by the indoor fan 7. Namely, the refrigerant mixture cools the room air by absorbing heat from the room air. The refrigerant mixture becomes a low-pressure vapor, which is passed through the four-way valve 2 to the compressor 1, which discharges a high-pressure high-temperature vapor of the refrigerant mixture. This completes the cooling cycle.

Figure 2:
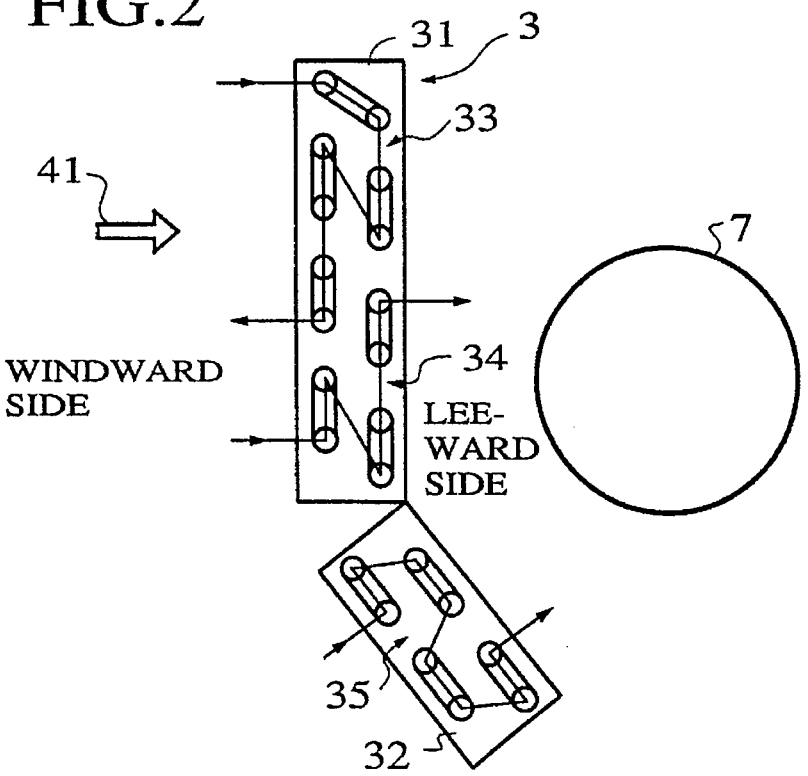
FIG. 2 shows an indoor heat exchanger and an indoor fan of the air conditioner of FIG. 1.

FIG. 2 shows the details of the indoor heat exchanger 3 and the position of the indoor fan 7. The indoor heat exchanger 3 has a V-shaped fin. The V-shaped fin consists of an upper fin 31 and a lower fin 32. The upper fin 31 involves first and second paths 33 and 34 each including rows of piping for passing the refrigerant mixture. The lower fin 32 involves a third path 35 including rows of piping for passing the refrigerant mixture.

An arrow mark 41 indicates an air flow produced by the indoor fan 7. The air moves from the left side of the indoor heat exchanger 3 toward the right side thereof. Namely, the left side of the indoor heat exchanger 3 is a windward side, and the right side thereof is a leeward side. Thick arrow marks represent the flows of the refrigerant mixture during a cooling cycle. During a heating cycle, the refrigerant mixture flows oppositely.

In the first path 33 on the upper fin 31, the refrigerant mixture flows on the leeward side and then on the windward side. Namely, the refrigerant mixture in the first path 33 flows from the leeward side toward the windward side. In the first path 33, the number of rows of piping on the windward side is greater than that on the leeward side. The rows of piping on the windward side do not overlap the rows of piping on the leeward side with respect to the air flow.

In the second path 34 on the upper fin 31, the refrigerant mixture flows on the windward side and then on the leeward side. Namely, the refrigerant mixture in the second path 34 flows from the windward side toward the leeward side. In the second path 34, the number of rows of piping on the leeward side is greater than that on the windward side. The rows of piping on the windward side do not overlap the rows of piping on the leeward side with respect to the air flow.

In the third path 35 on the lower fin 32, the refrigerant mixture flows on the windward side, then on the leeward side, again on the windward side, and then again on the leeward side. Namely, the refrigerant mixture in the third path 35 flows from the windward side toward the leeward side and again from the windward side toward the leeward side. Rows of piping on the windward side do not overlap the rows of piping on the leeward side.

Figure 3:
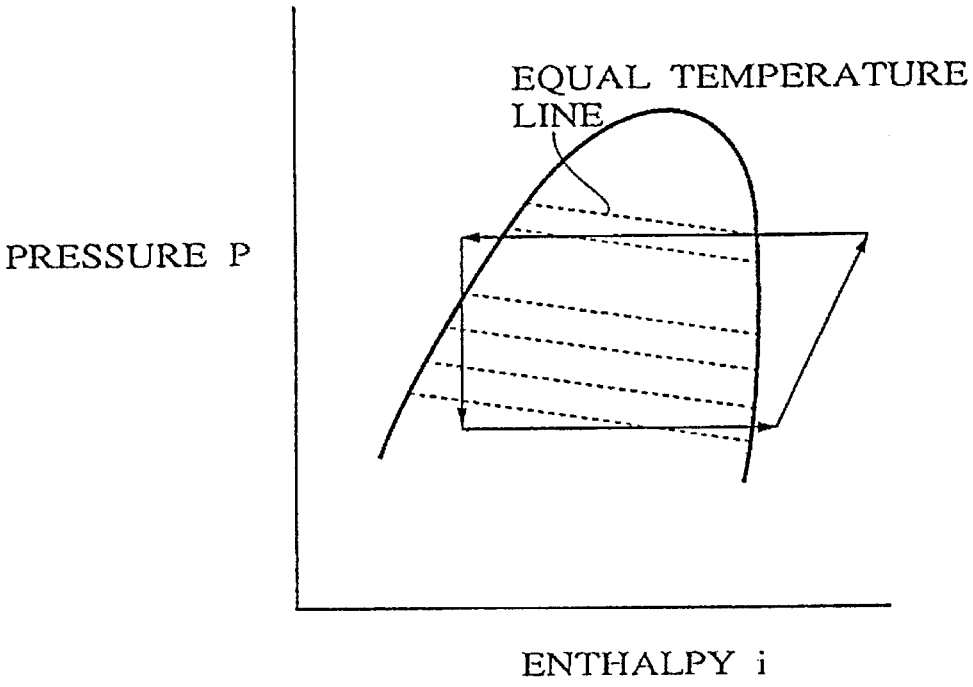
FIG. 3 is a Mollier diagram for explaining the temperature gradients of a non-azeotropic refrigerant mixture during a vapor-liquid changing process.

FIG. 3 is a Mollier diagram explaining a refrigerating cycle of a conventional air conditioner employing a non-azeotropic refrigerant mixture. As indicated with dotted lines, the conventional air conditioner shows large temperature gradients when the refrigerant mixture changes between vapor and liquid phases. Namely, the temperature of the refrigerant mixture is low at the inlet of an evaporator and high at the outlet thereof. The temperature of the same is high at the inlet of a condenser and low at the outlet thereof.

To solve this problem, the first path 33 on the upper fin 31 according to the present invention passes a refrigerant mixture from the leeward side toward the windward side during a cooling cycle, to form a counterflow of the refrigerant mixture with respect to the air flow, to improve the heat exchange efficiency of the non-azeotropic refrigerant mixture having the temperature gradient characteristic. This arrangement not only solves the above problem but also improves the heat-exchanging capability of the air conditioner.

The second path 34 on the upper fin 31 passes the refrigerant mixture from the windward side toward the leeward side in a cooling cycle. Although the second path 34 forms a parallel flow of the refrigerant mixture with respect to the air flow, the number of rows of piping on the leeward side is greater than that on the windward side, and the rows of piping do not overlap one another with respect to the air flow. Accordingly, air that is cooled by the refrigerant mixture on the windward side will not adversely affect the air-conditioning capability of the leeward side. Namely, the second path 34 demonstrates moderate heat-exchange efficiency.

The third path 35 on the lower fin 32 passes the refrigerant mixture repeatedly from the windward side toward the leeward side during a cooling cycle, to partly realize a counterflow of the refrigerant mixture with respect to the air flow, to improve heat-exchange efficiency.

During a heating cycle, the first path 33 on the upper fin 31 passes the refrigerant mixture from the windward side toward the leeward side, to form a parallel flow of the refrigerant mixture with respect to the air flow. Even so, air heated by the refrigerant mixture on the windward side will not adversely affect the air-conditioning capability of the leeward side because the number of rows of piping on the windward side is greater than that on the leeward side and because the rows of piping do not overlap one another with respect to the air flow. Accordingly, the first path 33 demonstrates moderate heat-exchange efficiency.

The second path 34 on the upper fin 31 passes the refrigerant mixture from the leeward side toward the windward side during the heating cycle, to form a counterflow of the refrigerant mixture with respect to the air flow, to improves heat-exchange efficiency. At this time, the third path 35 on the lower fin 32 passes the refrigerant mixture from the leeward side toward the windward side and again from the leeward side toward the windward side, to partly form a counterflow of the refrigerant mixture with respect to the air flow, to improve heat-exchange efficiency. Heating performance will be improved by achieving supercooling during condensation. For this purpose, it is preferable to arrange an outlet of the refrigerant mixture on the windward side where the temperature of air is low. This embodiment arranges one or two rows of outgoing refrigerant piping on the windward side in each path, to improve heating performance during heating by taking a subcooling.

Figure 4:
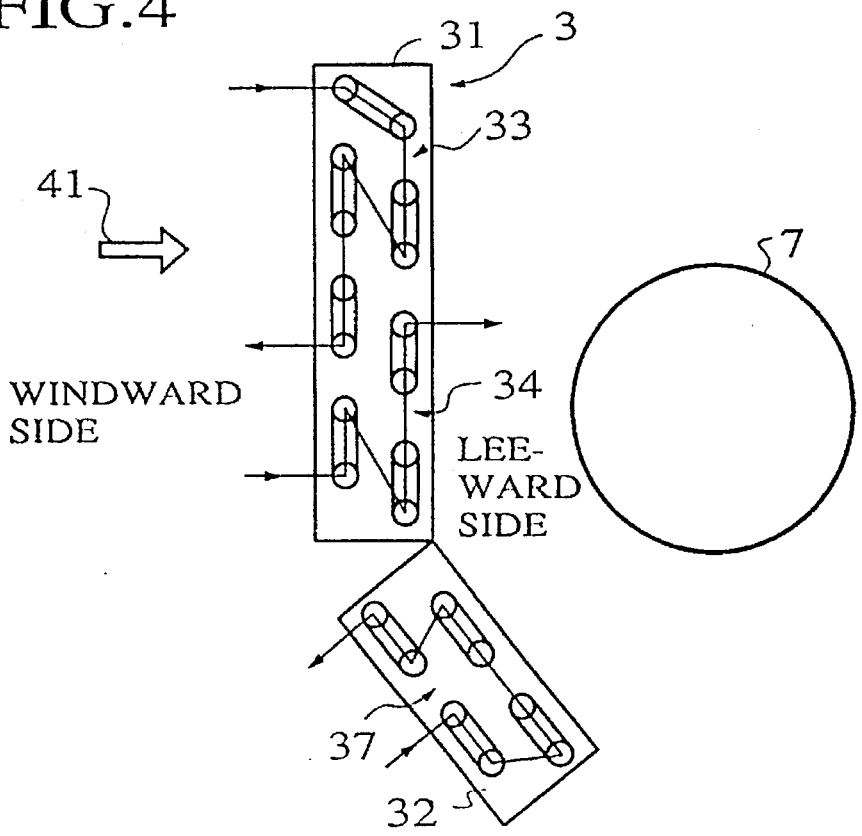
FIG. 4 shows an indoor heat exchanger and an indoor fan of an air conditioner according to another embodiment of the present invention.

FIG. 4 shows an indoor heat exchanger 30 and an indoor fan 7 of an air conditioner according to another embodiment of the present invention. The indoor heat exchanger 30 differs from the indoor heat exchanger 3 of FIG. 2 only in the arrangement of piping in the third path on the lower fin 32.

Namely, the third path 37 of the lower fin 32 of the indoor heat exchanger 30 of FIG. 4 passes a refrigerant mixture on the windward side, then on the leeward side, and again on the windward side, and discharges the refrigerant mixture from the windward side. That is, the third path 37 passes the refrigerant mixture from the windward side toward the leeward side, and from the leeward side toward the windward side. The refrigerant mixture flows into and comes out of the third path 37 on the windward side during a cooling cycle. During a heating cycle, the direction of the flow of the refrigerant mixture is reversed.

Since the piping in the third path 37 on the lower fin 32 of FIG. 4 is arranged to draw and discharge the refrigerant mixture on the same side, the piping is easy to install and simplifies the structure of the air conditioner.

Figure 5:
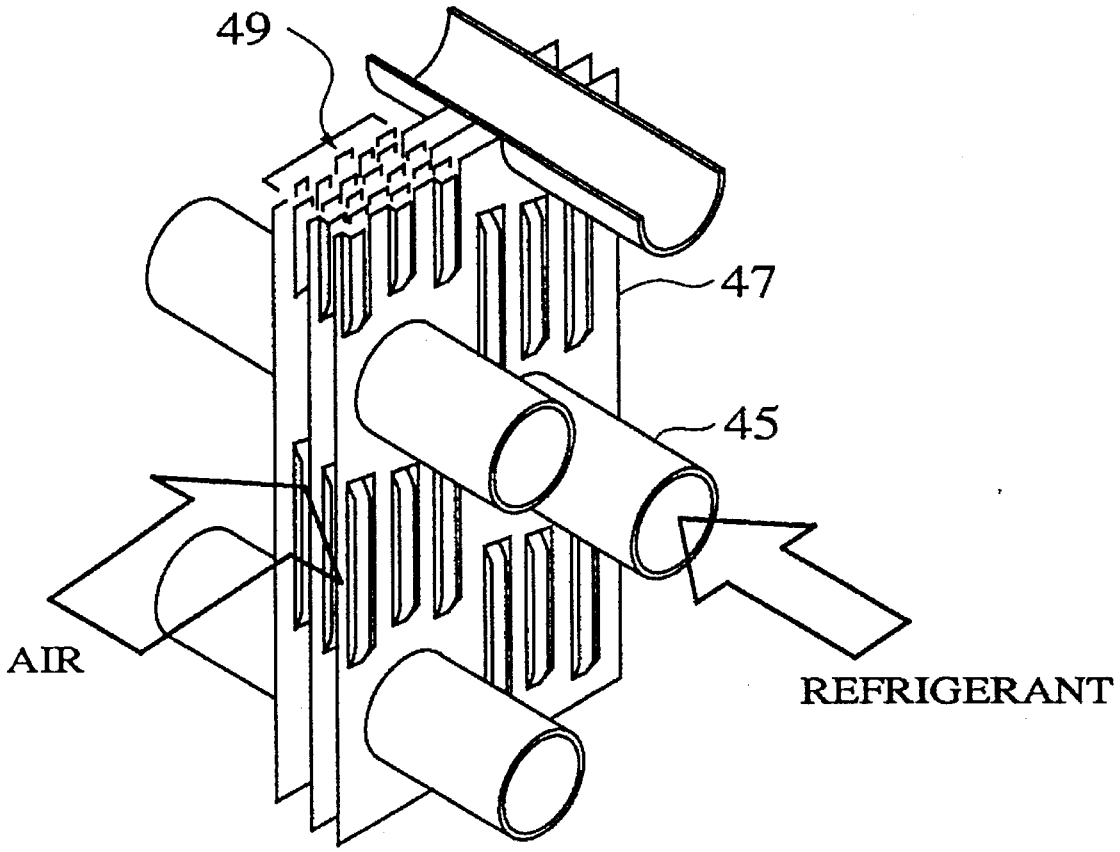
FIG. 5 is a perspective view of the indoor heat exchanger according to the present invention.

As shown in FIG. 5, the indoor heat exchanger includes tubes 45 made of copper and fins 47 made of aluminum. Air is transferred between the fins 47 in order to heat-exchange to the refrigerant transferred through the tubes 45. The fins 47 have off-set portions 49.

The first path 33, second path 34, and third path 35 or 37 may be independent of one another or may be connected to one another.

In summary, the present invention arranges rows of piping for passing a non-azeotropic refrigerant mixture on a fin of an indoor heat exchanger of an air conditioner so that the refrigerant mixture may flow, during a cooling cycle, from the leeward side toward the windward side of an air flow produced by an indoor fan. Namely, the refrigerant mixture forms a counterflow against the air flow, to thereby improve the heat-exchange efficiency and air-conditioning capability of the air conditioner.

The present invention forms refrigerant paths on a fin of an indoor heat exchanger of an air conditioner. Each of the paths involves rows of piping for passing a non-azeotropic refrigerant mixture. The paths are at least two among a path for passing the refrigerant mixture during a cooling cycle from the leeward side toward the windward side of an air flow produced by an indoor fan, a path for passing the refrigerant mixture during the cooling cycle from the windward side toward the leeward side of the air flow, and a path for passing the refrigerant mixture during the cooling cycle from the windward side toward the leeward side and again from the windward side toward the leeward side of the air flow. This arrangement creates a counterflow of the refrigerant mixture against the air flow, to improve the heat-exchange efficiency and air-conditioning capability.

According to the present invention, the indoor heat exchanger may be bent in a V shape, and the indoor fan is arrange on the inner side of the V-shape. An upper part of the V-shaped indoor heat exchanger includes two of the paths, and a lower part thereof includes one of the paths. This arrangement creates a counterflow of the refrigerant mixture against the air flow, to improve the heat-exchange efficiency and air-conditioning capability.

According to the present invention, the number of rows of piping on the windward side is greater than that on the leeward side in the path for passing the refrigerant mixture from the leeward side toward the windward side of the air flow. In the path for passing the refrigerant mixture from the windward side toward the leeward side of the air flow, the number of rows of piping on the leeward side is greater than that on the windward side. Accordingly, even in a path that forms a parallel flow of the refrigerant mixture with respect to the air flow, air cooled by the refrigerant mixture on the windward side during a cooling cycle does not adversely affect the air-conditioning performance of the leeward side and achieves moderate heat-exchange efficiency. During a heating cycle, air heated by the refrigerant mixture on the windward side does not adversely affect the heat-exchange performance of the leeward side and achieves moderate heat exchange efficiency.

The present invention forms paths on a fin of an indoor heat exchanger of an air conditioner. Each of the paths involves rows of piping for passing a non-azeotropic refrigerant mixture. The paths are at least two among a path for passing the refrigerant mixture during a cooling cycle from the leeward side toward the windward side of an air flow produced by an indoor fan, a path for passing the refrigerant mixture during the cooling cycle from the windward side toward the leeward side of the air flow, and a path for passing the refrigerant mixture during the cooling cycle from the windward side toward the leeward side and again from the windward side toward the leeward side of the air flow with the refrigerant mixture flowing into and coming out of the path on the same side. This arrangement creates a counterflow of the refrigerant mixture against the air flow, to improve the heat-exchange efficiency and air-conditioning capability of the air conditioner. In addition, the piping is easy to install on the same side, to realize a simple structure.

The foregoing description of preferred embodiments has been presented for purposes of illustration and description. It is not intended to be exhaustive or to limit the invention to the precise form described, and obviously many modifications and variations are possible in light of the above teaching. The embodiments were chosen in order to explain most clearly the principles of the invention and its practical application thereby to enable others in the art to utilize most effectively the invention in various embodiments and with various modifications as are suited to the particular use contemplated.

What is claimed is:

1. An air conditioner achieving a refrigerating cycle by using air as a heat source, comprising:

a compressor for compressing a low-temperature low-pressure non-azeotropic refrigerant mixture, to increase the temperature thereof;

an outdoor heat exchanger for cooling, with outdoor air, the high-temperature high-pressure refrigerant mixture compressed by the compressor and condensing the refrigerant into a liquid;

a throttle device for reducing the pressure of the liquefied high-pressure refrigerant mixture supplied from the outdoor heat exchanger; and an indoor heat exchanger for heating, with room air, the pressure-reduced liquid refrigerant mixture and evaporating the refrigerant into a vapor, which is returned to said compressor, said indoor heat exchanger comprising (a) a plurality of parallel pipes connected in sequence and passing through fins extending in a direction parallel to the air flow for heat exchange, and (b) a fan for blowing air toward the parallel pipes, wherein the parallel pipes are arranged in a plurality of rows extending in a direction perpendicular to the air flow and including a plurality of groups of single or consecutive pipes, each adjacent two of the groups being located in adjacent rows, the number of pipes of the adjacent groups which are arranged from a leeward side toward the windward side of the air flow produced by the fan during a cooling cycle being larger than the number of pipes of the adjacent groups which are arranged from a windward side toward the leeward side of the air flow produced by the fan during the cooling cycle, wherein one group does not directly feed refrigerant to another group.

2. The air conditioner as claimed in claim 1, wherein said compressor is provided with switching means for changing between the supplying of the flow of the evaporated high-temperature high-pressure refrigerant mixture provided by said compressor to the indoor heat exchanger and the supplying of the flow of the refrigerant mixture to the outdoor heat exchanger, in order to properly switch cooling and heating cycles from one to another.

3. An air conditioner achieving a refrigerating cycle by using air as a heat source, comprising:

a compressor for compressing a low-temperature low-pressure non-azeotropic refrigerant mixture, to increase the temperature thereof;

an outdoor heat exchanger for cooling, with outdoor air, the high-temperature high-pressure refrigerant mixture compressed by the compressor and condensing the refrigerant into a liquid;

a throttle device for reducing the pressure of the liquified high-pressure refrigerant mixture supplied from the outdoor heat exchanger; and an indoor heat exchanger for heating, with room air, the pressure-reduced liquid refrigerant mixture and evaporating the refrigerant into a vapor, which is returned to said compressor, said indoor heat exchanger comprising (a) a plurality of parallel pipes connected in sequence and passing through fins extending in a direction parallel to the air flow for heat exchange, and (b) a fan for blowing air toward the parallel pipes, wherein the parallel pipes are arranged in a plurality of rows extending in a direction perpendicular to the air flow and including a plurality of groups of single or consecutive pipes, some of the rows of piping being arranged to pass the refrigerant mixture from a windward side toward a leeward side of the air flow produced by the fan during a cooling cycle each adjacent two of the groups being located in adjacent rows, the number of pipes of the adjacent groups which are arranged from a leeward side toward a windward side of the air flow produced by the fan during the cooling cycle being larger than the number of pipes of the adjacent groups which are arranged from the windward side toward the leeward side of the air flow produced by the fan during the cooling cycle, wherein one group does not directly feed refrigerant to another group.

4. An air conditioner achieving a refrigerating cycle by using air as a heat source, comprising:

a compressor for compressing a low-temperature low-pressure non-azeotropic refrigerant mixture, to increase the temperature thereof;

an outdoor heat exchanger for cooling, with outdoor air, the high-temperature high-pressure refrigerant mixture compressed by the compressor and condensing the refrigerant into a liquid;

a throttle device for reducing the pressure of the liquefied high-pressure refrigerant mixture supplied from the outdoor heat exchanger; and an indoor heat exchanger for heating, with room air, the pressure-reduced liquified refrigerant mixture and evaporating the refrigerant into a vapor, which is returned to said compressor, said indoor heat exchanger comprising (a) a plurality of parallel pipes connected in sequence and passing through fins extending in a direction parallel to the air flow for heat exchange, and (b) a fan for blowing air toward the parallel pipes, wherein the parallel pipes are arranged in a plurality of rows extending in a direction perpendicular to the air flow and including a plurality of groups of single or consecutive pipes, each adjacent two of the groups being located in adjacent rows, the number of pipes of the adjacent groups which are arranged from a leeward side toward a windward side of the air flow produced by the fan during a cooling cycle being larger than the number of pipes of the adjacent groups which are arranged from the windward side toward the leeward side of the air flow produced by the fan during the cooling cycle, some of the rows of piping being arranged to pass the refrigerant mixture from the windward side toward the leeward side and again from the windward side toward the leeward side, wherein one group does not directly feed refrigerant to another group.

5. The air conditioner as claimed in claim 1, wherein said indoor heat exchanger is bent in a V shape and the fan is arranged on the inner side of the V shape.

6. The air conditioner as claimed in claim 5, wherein an upper part of said V-shaped indoor heat exchanger involves two paths for passing the refrigerant mixture and a lower part thereof involves one path for passing the refrigerant mixture.

7. An air conditioner achieving a refrigerating cycle by using air as a heat source, comprising:

a compressor for compressing a low-temperature low-pressure non-azeotropic refrigerant mixture, to increase the temperature thereof;

an outdoor heat exchanger for cooling, with outdoor air, the high-temperature high-pressure refrigerant mixture compressed by the compressor and condensing the refrigerant into a liquid;

a throttle device for reducing the pressure of the liquified high-pressure refrigerant mixture supplied from the outdoor heat exchanger; and an indoor heat exchanger for heating, with room air, the pressure-reduced liquid refrigerant mixture and evaporating the refrigerant into a vapor, which is returned to said compressor, said indoor heat exchanger comprising (a) a plurality of parallel pipes connected in sequence and passing through fins extending in a direction parallel to the air flow for heat exchange, and (b) a fan for blowing air toward the parallel pipes, wherein the parallel pipes are arranged in a plurality of rows extending in a direction perpendicular to the air flow and including a plurality of groups of single or consecutive pipes, some of the rows of piping being arranged to pass the refrigerant mixture from a windward side toward a leeward side of the air flow produced by the fan during a cooling cycle each adjacent two of the groups being located in adjacent rows, the number of pipes of the adjacent groups which are arranged from a leeward side toward a windward side of the air flow produced by the fan during the cooling cycle being larger than the number of pipes of the adjacent groups which are arranged from the windward side toward the leeward side of the air flow produced by the fan during the cooling cycle, wherein, in the path for passing the refrigerant mixture from the leeward side toward the windward side of the air flow, the number of rows of piping on the windward side is greater than that on the leeward side, and in the path for passing the refrigerant mixture from the windward side toward the leeward side of the air flow, the number of rows of piping on the leeward side is greater than that on the windward side.

8. The air conditioner as claimed in claim 3, wherein the rows of piping for passing the refrigerant mixture are arranged on a single plate fin of said indoor heat exchanger.

9. The air conditioner as claimed in claim 3, wherein said indoor heat exchanger is bent in a V shape and the fan is arranged on the inner side of the V shape.

10. The air conditioner as claimed in claim 4, wherein said indoor heat exchanger is bent in a V shape and the fan is arranged on the inner side of the V shape.

11. The air conditioner as claimed in claim 4, wherein the rows of piping for passing the refrigerant mixture are arranged on a single plate fin of said indoor heat exchanger.

12. The air conditioner as claimed in claim 5, wherein the rows of piping for passing the refrigerant mixture are arranged on a single plate fin of said indoor heat exchanger.

13. The air conditioner as claimed in claim 6, wherein the rows of piping for passing the refrigerant mixture are arranged on a single plate fin of said indoor heat exchanger.

14. The air conditioner as claimed in claim 7, wherein the rows of piping for passing the refrigerant mixture are arranged on a single plate fin of said indoor heat exchanger.

15. An air conditioner achieving a refrigerating cycle by using air as a heat source, comprising:

a compressor for compressing a low-temperature low-pressure non-azeotropic refrigerant mixture, to increase the temperature thereof;

an outdoor heat exchanger for cooling, with outdoor air, the high-temperature high-pressure refrigerant mixture compressed by the compressor and condensing the refrigerant into a liquid;

a throttle device for reducing the pressure of the liquified high-pressure refrigerant mixture supplied from the outdoor heat exchanger; and an indoor heat exchanger for heating, with room air, the pressure-reduced liquid refrigerant mixture and evaporating the refrigerant into a vapor, which is returned to said compressor, said indoor heat exchanger comprising a plurality of parallel pipes connected in sequence and passing through fins extending in a direction parallel to the air flow for heat exchange, said parallel pipes being arranged in a leeward side row and a windward side row, wherein first and second paths are formed by said parallel pipes, said first path comprising consecutive pipes through which said refrigerant mixture flows in first leeward side pipes of the consecutive pipes of said first path arranged in said leeward side row and thereafter in first windward side pipes of the consecutive pipes of said first path arranged in said windward side row, said second path comprising consecutive pipes through which said refrigerant mixture flows first in second windward side pipes of the consecutive pipes of said second path arranged in said windward side row and thereafter in second leeward side pipes of the consecutive pipes of said second path arranged in said leeward side row.

16. An air conditioner achieving a refrigerating cycle by using air as a heat source, comprising:

a compressor for compressing a low-temperature low-pressure non-azeotropic refrigerant mixture, to increase the temperature thereof;

an outdoor heat exchanger for cooling, with outdoor air, the high-temperature high-pressure refrigerant mixture compressed by the compressor and condensing the refrigerant into a liquid;

a throttle device for reducing the pressure of the liquified high-pressure refrigerant mixture supplied from the outdoor heat exchanger; and an indoor heat exchanger for heating, with room air, the pressure-reduced liquid refrigerant mixture and evaporating the refrigerant into a vapor, which is returned to said compressor, said indoor heat exchanger having rows of piping for passing the refrigerant mixture and a fan for blowing air toward the piping, some of the rows of piping being arranged to pass the refrigerant mixture from the windward side toward the leeward side of the air flow produced by the fan during a cooling cycle, wherein, in the path for passing the refrigerant mixture from the leeward side toward the windward side of the air flow, the number of rows of piping on the windward side is greater than that on the leeward side, and in the path for passing the refrigerant mixture from the windward side toward the leeward side of the air flow, the number of rows of piping on the leeward side is greater than that on the windward side.

17. The air conditioner as claimed in claim 16, wherein the rows of piping for passing the refrigerant mixture are arranged on a single plate fin of said indoor heat exchanger.

* * * * *